US009284712B2

(12) United States Patent
Bradley et al.

(10) Patent No.: US 9,284,712 B2
(45) Date of Patent: Mar. 15, 2016

(54) UNIVERSAL QUICK COUPLER FOR BACKHOE

(71) Applicant: CNH Industrial America LLC, New Holland, PA (US)

(72) Inventors: Nathan J. Bradley, Muscatine, IA (US); Vikram Nair, Burlington, IA (US); Matthew D. Wagenbach, Burlington, IA (US); David J. Sanning, Burlington, IA (US); Ronald C. Natzke, Burlington, IA (US)

(73) Assignee: CNH Industrial America LLC, New Holland, PA (US)

( * ) Notice: Subject to any disclaimer, the term of this patent is extended or adjusted under 35 U.S.C. 154(b) by 43 days.

(21) Appl. No.: 14/292,389

(22) Filed: May 30, 2014

(65) Prior Publication Data

US 2015/0345104 A1 Dec. 3, 2015

(51) Int. Cl.
*E02F 3/36* (2006.01)

(52) U.S. Cl.
CPC ..... *E02F 3/3604* (2013.01); *E02F 3/3613* (2013.01); *E02F 3/3622* (2013.01); *E02F 3/3631* (2013.01); *E02F 3/3686* (2013.01)

(58) Field of Classification Search
CPC ..... E02F 3/3604
USPC ..... 414/723
See application file for complete search history.

(56) References Cited

U.S. PATENT DOCUMENTS

| | | | | | |
|---|---|---|---|---|---|
| 4,133,121 | A * | 1/1979 | Hemphill | E02F 3/3604 | 37/444 |
| 4,207,693 | A * | 6/1980 | Hemphill | E02F 3/3604 | 37/195 |
| 4,436,477 | A | 3/1984 | Lenertz et al. | | |
| 4,452,560 | A * | 6/1984 | Coyle | E02F 3/3618 | 172/273 |
| 5,256,026 | A * | 10/1993 | Kishi | E02F 3/3631 | 403/321 |
| 5,927,665 | A | 7/1999 | Grabnic | | |
| 6,233,852 | B1 | 5/2001 | Pemberton | | |
| 6,364,561 | B1 | 4/2002 | Droegemueller | | |
| 6,508,616 | B2 | 1/2003 | Hung | | |
| 6,922,926 | B2 | 8/2005 | Miller et al. | | |
| 7,770,311 | B2 | 8/2010 | Hahnel | | |
| 7,779,562 | B1 * | 8/2010 | Loveless | E02F 3/3627 | 37/231 |
| 8,622,645 | B2 | 1/2014 | Hill | | |

FOREIGN PATENT DOCUMENTS

| | | | | |
|---|---|---|---|---|
| JP | 7-305374 A | * | 11/1995 | E02F 3/40 |
| JP | H07305374 A | | 11/1995 | |
| JP | H08226139 A | | 9/1996 | |

* cited by examiner

*Primary Examiner* — Gerald McClain
(74) *Attorney, Agent, or Firm* — Patrick M. Sheldrake

(57) ABSTRACT

A universal coupler for a backhoe assembly in which a first link is pivotally connected to the articulation joints of the backhoe assembly. Mounting holes for a first and third style bucket with equal pin spacing are provided on the first link. A second link is connected to the first position and is pivotal between a first position in which the mounting holes are exposed and a second position in which the second link covers the holes on the first link and provides the mounting hole diameter and pin spacing for a bucket having a greater pin spacing.

17 Claims, 6 Drawing Sheets

UNIVERSAL QUICK COUPLER FOR BACKHOE

BACKGROUND OF THE INVENTION

1. Field of the Invention

The present invention relates to tractor loader backhoe and units more specifically to a universal connector for such devices.

2. Description of the Related Art

One of the most common work machines utilized in the construction field is a tractor loader backhoe which has a loader on the front of the tractor and a backhoe on the rear portion. There are a number of manufacturers of tractors for this purpose as well as bucket styles for the backhoe sections. The variety of equipment has generated a need for universal couplers designed to easily connect the tractor to the bucket of a backhoe assembly. Very often, the usable life of a bucket exceeds that of the equipment with which it is associated. When purchasing new equipment, it is desirable to be able to utilize existing bucket assemblies. It is common in the field to have a rear pin for the bucket which is received in a C shaped slot configured to accommodate a variety of rear pin types. However the front pin configuration for the different bucket styles varies, both in terms of pin diameter, and in the spacing of the flanges on the buckets. While a variation of diameter and distance from the C-shaped slot can be readily accommodated, it becomes much more difficult to adapt to a difference in pin diameter as well as pin spacing.

In the past, the variation in spacing has been taken up with sleeve inserts, shims/spacers and other complex mechanisms. These can easily be lost during operation and are difficult and time-consuming to install.

What is needed in the art is a universal coupler that accommodates different style buckets in a simplified and effective manner.

SUMMARY OF THE INVENTION

The present invention facilitates the connection of multiple styles of buckets to a backhoe assembly.

The invention, in one form, is directed to a universal coupler for connecting multiple style buckets to the articulation joints of a single style work machine. The coupler includes at least a first link having a mounting hole at one end for connecting with the pivot support of the work machine. The first link has a C-shaped slot for receiving one of multiple styles of buckets. A second link is connected to the first link and is pivotal between first and second positions, the first position of the second link exposing a first mounting hole and spacing for corresponding mounting holes on a first style of bucket having aligned mounting holes with a spacing dependent upon the first link. The second position of the second link covers the first mounting hole on the first link, the second link having a second mounting hole and spacing for corresponding mounting holes on a second style of bucket having aligned mounting holes with a spacing dependent upon the second link.

The invention, in another form, is directed to a work machine including mounting points for articulated movement of a bucket, the links including a pivotal link and a second link for movement relative to the pivotal link. A universal coupler for connecting multiple style buckets to the articulation joints of the single style work machine includes at least a first link having a mounting hole at one end for connecting with the pivot support of the work machine. The first link has a C-shaped slot for receiving one of multiple styles of buckets. A second link is connected to the first link and is pivotal between first and second positions, the first position of the second link exposing a first mounting hole and spacing for corresponding mounting holes on a first style of bucket having aligned mounting holes with a spacing dependent upon the first link. The second position of the second link covers the first mounting hole on the first link, the second link having a second mounting hole and spacing for corresponding mounting holes on a second style of bucket having aligned mounting holes with a spacing dependent upon the second link. A bucket of a given style is received in the C-shaped slot and is mounted to its respective mounting holes by a pin.

An advantage of the present invention is a simplified and reliable universal coupler that easily accommodates both pin diameter variations as well as pin spacing.

Another advantage is a universal coupler with the parts used to accommodate different style of buckets being permanently connected to the universal coupler.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

Figure 1:
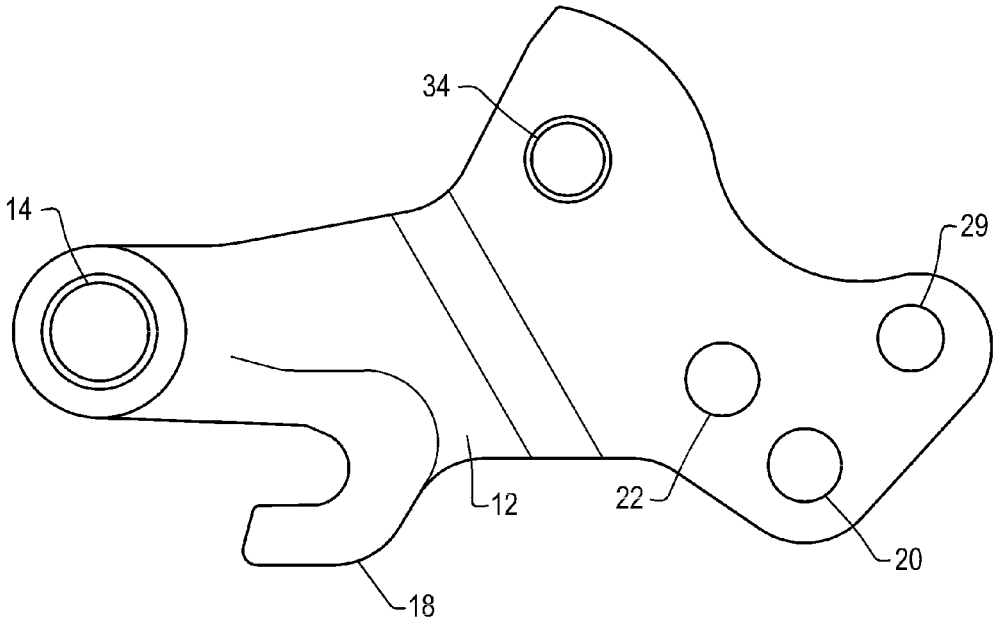
FIG. 1 is an enlarged side view of a component of a universal coupler embodying the present invention.
Figure 2:
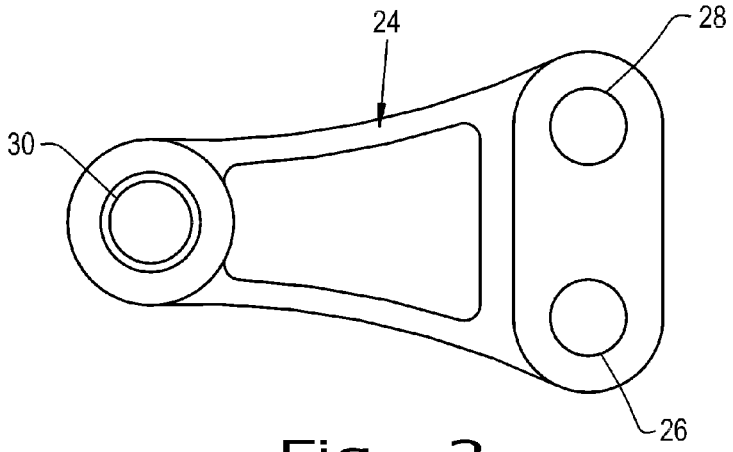
FIG. 2 is an enlarged side view of another component of the universal coupler of FIG. 1.

Referring now to the drawings, and more particularly to FIGS. 1, and 2, there is shown a universal coupler 10 for use between the articulation mounting points of a backhoe assembly of a work machine such as a tractor loader backhoe (TLB). As shown in FIG. 1, universal coupler 10 includes first link 12 which may be cast, forged or welded steel plates. A pivotal mounting hole 14 is formed at one end and this will be connected to the dipper end of a backhoe assembly as described below. First link 12 is connected to the dipper end with pressed bushings 16 and a pin 42 through hole 14. Link 12 has a first bucket mounting hole 20 spaced adjacent its far end and a third bucket mounting hole 22 spaced from the hole 20. Hole 22 may have a smaller diameter than hole 20 but it will have essentially the same pin spacing as for hole 20 since the mounting holes are essentially in the same plane on link 12.

As shown in FIG. 2, a pair of second links 24 is connected to the first link 12 on either side and has second link mounting holes 26 and 28 with the second link 24 being formed in generally a triangular configuration. A mounting hole 29 on the first link is aligned with either hole 26 or 28 depending upon the position of the second link. The second link has a pivotal mounting hole 30 which receives a pivotal mounting pin 32 extending through a pivotal mounting hole 34 on the first link 12 with the holes 30 and 34 being in alignment.

Figure 3:
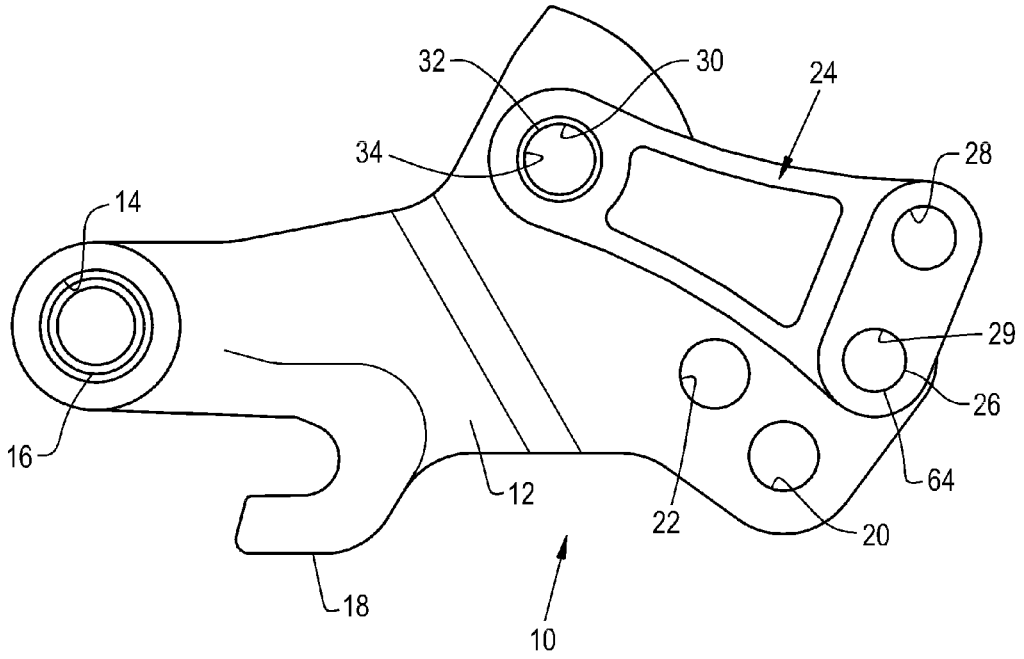
FIG. 3 is an enlarged side view of the universal coupler made up from the components of FIGS. 1 and 2 in a first position.
Figure 4:
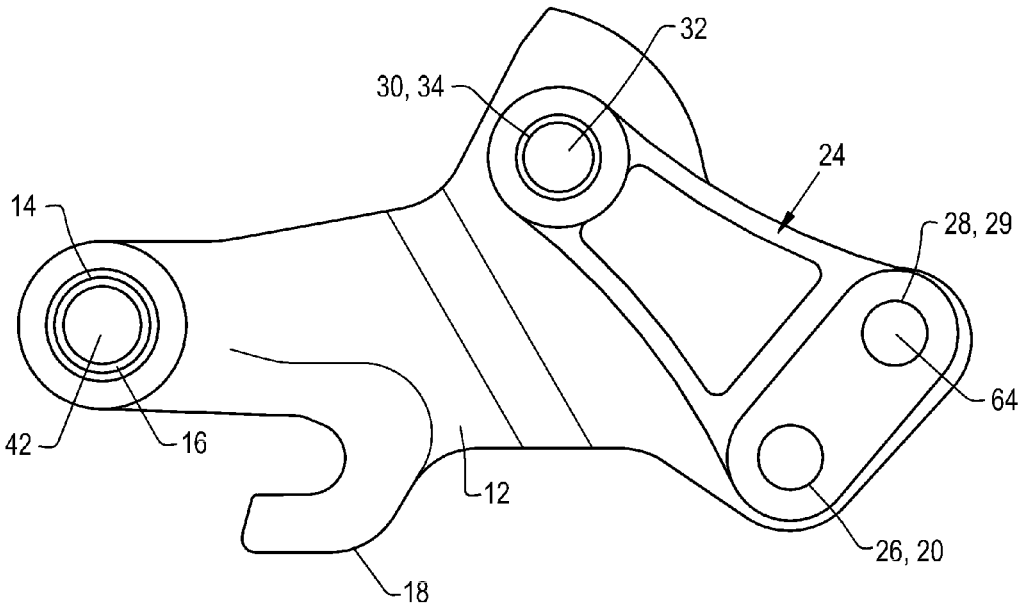
FIG. 4 is an enlarged side view of the universal coupler made up from the components of FIGS. 1 and 2 in a second position.

The second link 24 is positioned on the outer sides of the link 12 and is pivotal between a first position shown in FIG. 3 in which a pin 64 extends through mounting holes 29 and 26 and a second position shown in FIG. 4. In accordance with the present invention the second links 24 are moved between the first position and the second position to reliably and effectively accommodate different styles of buckets as described below. First link may be provided in a form in which a pair of first links are spaced and structurally interconnected with the second links 24 being positioned on the outer faces of the pair of first links.

Figure 5:
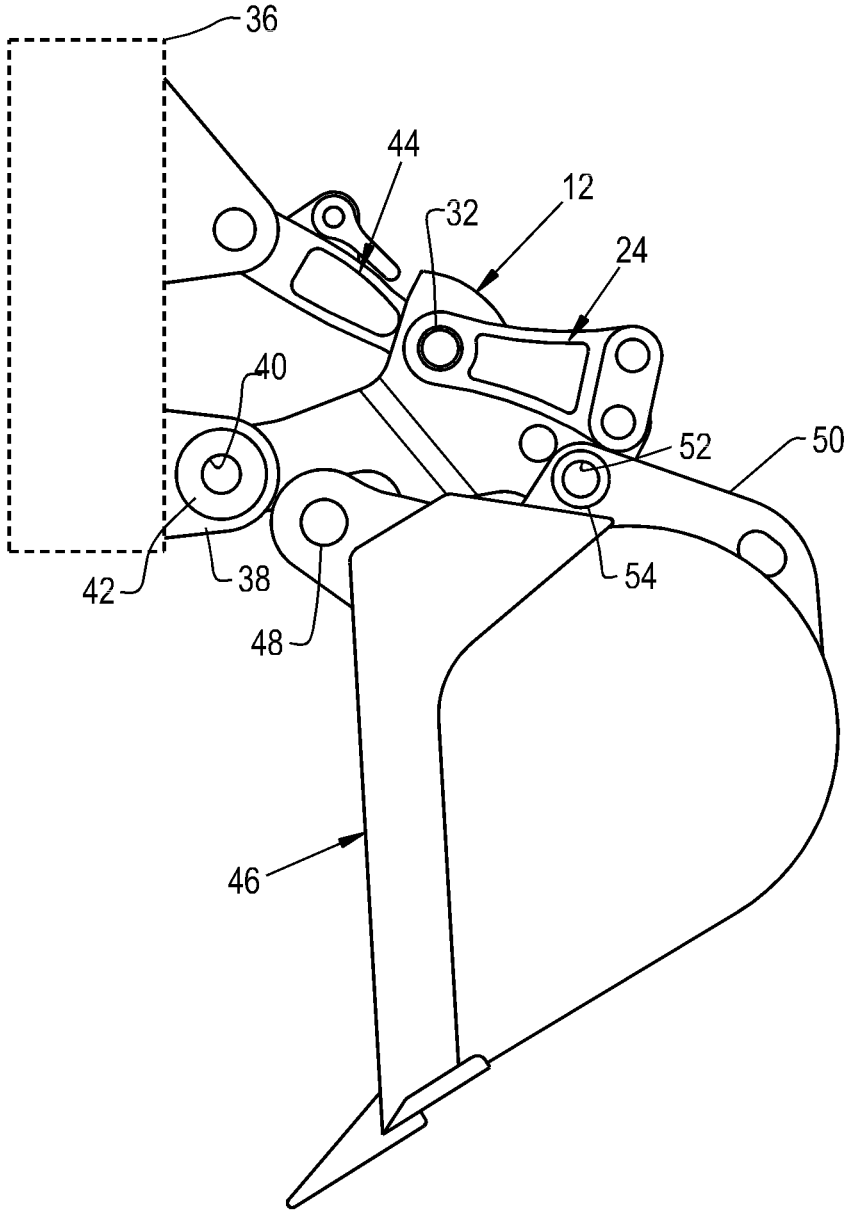
FIG. 5 is a view of the universal coupler of FIG. 1 shown in connection with a work machine and a first style of bucket.

Referring to FIG. 5, there is shown in schematic fashion a work machine 36 which includes a dipper link 38 including a pivotal mounting hole 40 which receives connecting pin 42 insertable in mounting hole 14 of the first link to allow a pivotal movement. A dump link mechanism 44 is appropriately connected to the pivotal mounting pin 32 that extends through the first and second links 12 and 24. Details of the dipper link 38 and dump link mechanism 44 are not shown to facilitate a clear understanding of the present invention. It should be understood however through the use of appropriate articulated links and hydraulic actuators, the mechanisms are used to elevate lower and pivot any bucket that is attached to the mechanism.

The universal coupler 10 is used to connect to a first style of bucket 46 has a rear mounting pin 48 received in the C shaped universal slot 18 and a flange 50 with a mounting hole 52 in alignment with mounting hole 20 in link 12 to receive a front mounting pin 54. The diameter of hole 20 is sized to match the mounting hole 52 so that when the universal coupler 10 is pivoted, the holes align and pin 54 may be inserted and held in place with appropriate clips. In addition to the hole diameter, the spacing of the flanges 50 on first bucket style 46 is set by the distance between the outer surfaces of link 12.

Figure 6:
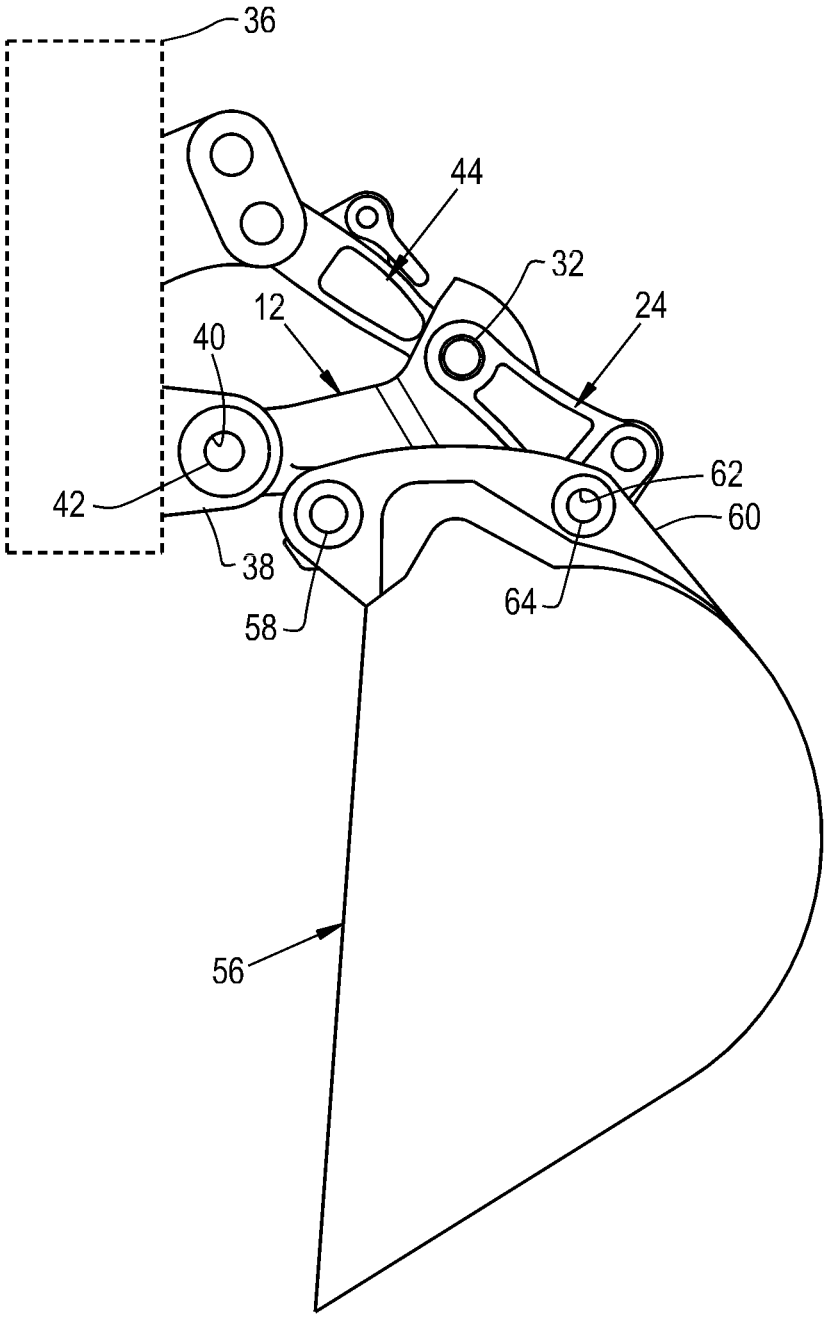
FIG. 6 is a view of the universal coupler of FIG. 1 shown in connection with a work machine and a second style of bucket.

While this works for bucket styles having the same pin spacing for the front pins, it does not apply to the second style shown in FIG. 6. In this figure, a second bucket style 56 is shown with a rear pin 58 received in C-shaped slot 18 but with a flange 60 and mounting hole 62 having a different diameter and different pin spacing compared to the first bucket style 46. For this purpose, the second link 24 is moved to its second position, illustrated in FIG. 4, in which the link 24 covers mounting hole 20 with mounting hole 26. In this position, the diameter of mounting hole 26 is selected to match the diameter of hole 62 to receive pin 64. Thus, the increased pin spacing is accommodated by the thickness provided by second link 24. The pin that resides in hole 26 on link 24 is moved to hole 28 in the second position. This supports the second link 24 on the first link 12 via alignment of the holes 28 and 29 as well as holes 30 and 34. With the simple movement of link 24 to its second position, a different pin spacing is accommodated. As a result the forces acting through the template mechanism 44 extends through 10 and through link 24 via pin 32 and to the flange 60 via pin 64. Although the diameter of hole 62 is smaller than the diameter of hole 20, the mechanism can still accommodate the pin arrangement with a diameter of up to the diameter of mounting hole 20.

Figure 7:
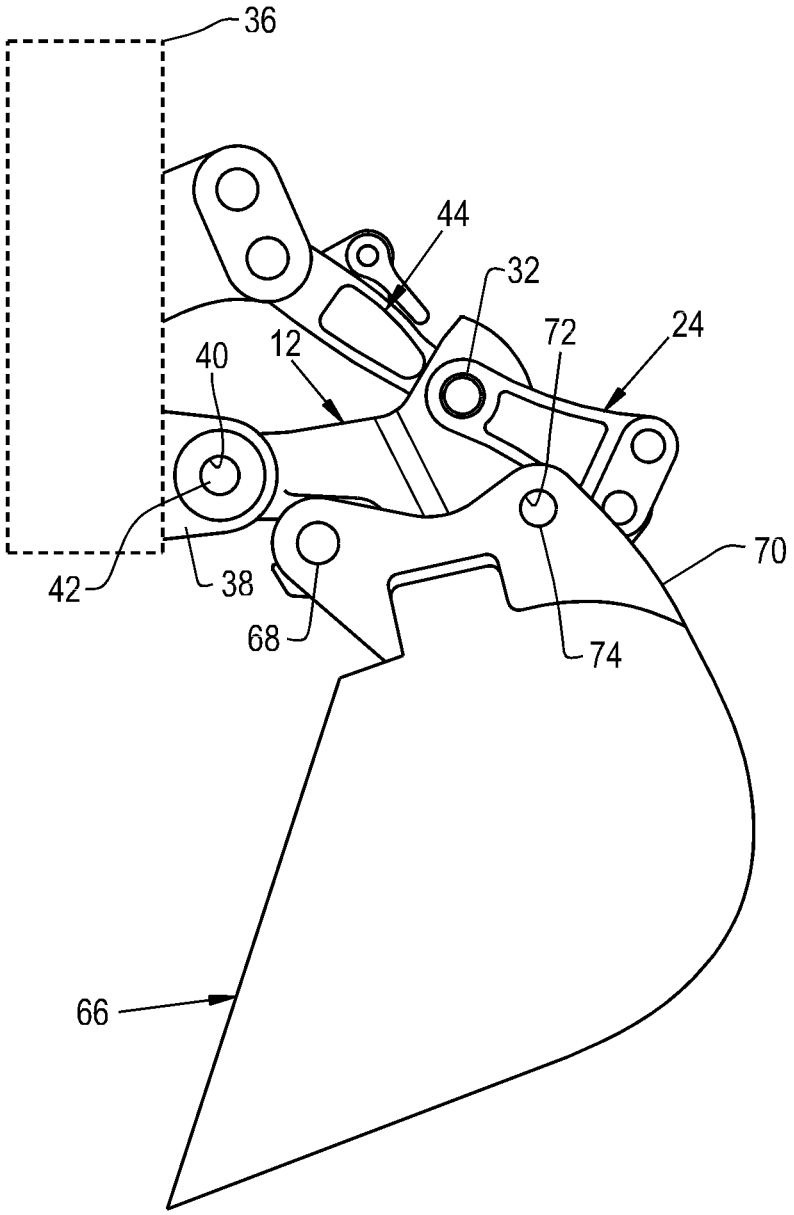
FIG. 7 is a view of the universal coupler of FIG. 1 shown in connection with a work machine and a third style of bucket.

FIG. 7 shows yet another a third style of bucket 66 having a rear pin 68 adapted to be received in C-shaped slot 18 and a mounting flange 70 with a mounting hole 72 for receiving pin 74. Hole 72 in flange 70 of bucket 66 can be aligned with and is of the same diameter as mounting hole 22 on first link 12. Since bucket 66 is wide enough on the rear pin to seat perfectly in the width of the rear C-shaped slot of link 12, the first link 12 can be utilized with a hole that is spaced from the front mounting hole for bucket 46. In addition, the diameter of mounting hole 22 can be essentially independent of the diameter of mounting hole 20.

It is apparent from FIGS. 3, 5 and 7 that with the second link 24 in its first position, it will act as a stop to facilitate the alignment of the respective mounting holes on the buckets with the holes on the first link 12. This greatly enhances the speed and efficiency of making a connection to a different style bucket. By utilizing link 24 to be pivotally connected to link 12, the possibility of losing or misplacing the adjustable portion of the coupler 10 is minimized if not eliminated.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A universal coupler for connecting multiple style buckets to the articulation joints of a single style work machine, said coupler comprising:

at least a first link having a mounting hole at one end for connecting with a pivotal support on the work machine, said link having a hook section for receiving one of multiple styles of buckets;

a second link connected to said first link and pivotal between first and second positions around a pivot axis, the first position of said second link exposing a first mounting hole and spacing for corresponding mounting holes on a first style of bucket having aligned mounting holes with a spacing dependent upon the first link, and a second position of said second link completely covering said first mounting hole, said second link having a second mounting hole and spacing for corresponding mounting holes on a second style of bucket having aligned holes with spacing dependent upon said second link;

wherein the pivot axis and an axis of the second mounting hole are separate axes.

2. The universal coupler of claim 1, wherein the second mounting hole is smaller in diameter than the first mounting hole.

3. The universal coupler of claim 2, wherein the second link has two spaced mounting holes, one of said spaced second mounting holes being used to secure the second link in place on said first link.

4. The universal coupler of claim 3, wherein the spaced mounting holes on the second link have the same diameter.

5. The universal coupling of claim 4, wherein the second link is generally triangular in shape.

6. The universal coupler of claim 1, having a pair of spaced first and second links connected by a structural element, wherein the spacing of the first style of bucket is the distance between the first links and the spacing for the second style of bucket is set by the spacing of the second links in said second position.

7. The universal coupler of claim 6, wherein the second link in the first position acts as a stop for facilitating the connection of the first style of bucket.

8. The universal coupler of claim 7, wherein the second hole in said second link is smaller in diameter than the first mounting hole in said first link.

9. A work machine comprising mounting points for articulated movement of a bucket, said links including a pivotal link and a second link for movement relative to said pivotal link;

a universal coupler for connecting multiple style buckets to the articulation joints, said coupler comprising at least a first link having a mounting hole at one end for connecting with the pivot support on the work machine, said link having a hook section for securing one of multiple styles of buckets;

a second link connected to said first link and pivotal between first and second positions around a pivot axis, first position of said second link exposing a first mounting hole and spacing for corresponding mounting holes on a first style of bucket having aligned mounting holes with a spacing dependent up on the first link, the second position of said link completely covering said first mounting hole, said second link having a second mounting hole and spacing for corresponding mounting holes of a second style of bucket having aligned mounting holes with a spacing dependent upon said second link; and, a bucket of a given style received in the C-shaped slot and mounted to its respective mounting holes by a pin;

wherein the pivot axis and an axis of the second mounting hole are separate axes.

10. The work machine of claim 9, wherein the second mounting hole in said second link is smaller in diameter than the first mounting hole in said first link.

11. The work machine of claim 10, wherein the second link has two spaced mounting holes, one of which is used to secure the second link in place on said first link.

12. The work machine of claim 11, wherein the spaced mounting holes on said second link have the same diameter.

13. A work machine of claim 12, wherein the second link is generally triangular in shape.

14. A work machine of claim 9, having a pair of spaced first and second links connected by a structural element, wherein the spacing of the first style of bucket is the distance between the first links and the spacing for the second style of bucket is set by the spacing of the second links in said second position.

15. The work machine of claim 14, wherein the link in said first position acts as a stop for installation of the first style of bucket.

16. The work machine of claim 15, wherein the second hole in said second link is smaller in diameter than said first link.

17. The work machine of claim 9, having two holes in said first link for accommodating a third style of bucket.

* * * * *